US006930664B2

(12) United States Patent
Kim et al.

(10) Patent No.: US 6,930,664 B2
(45) Date of Patent: Aug. 16, 2005

(54) LIQUID CRYSTAL DISPLAY

(75) Inventors: Jong Dae Kim, Kumi-shi (KR); Jong Sang Baek, Kumi-shi (KR)

(73) Assignee: LG. Philips LCD Co., Ltd., Seoul (KR)

( * ) Notice: Subject to any disclaimer, the term of this patent is extended or adjusted under 35 U.S.C. 154(b) by 298 days.

(21) Appl. No.: 10/175,803

(22) Filed: Jun. 21, 2002

(65) Prior Publication Data

US 2003/0193459 A1 Oct. 16, 2003

(30) Foreign Application Priority Data

Apr. 12, 2002 (KR) ..... 2002-20151

(51) Int. Cl.[7] ..... G09G 3/36
(52) U.S. Cl. ..... 345/99; 345/214
(58) Field of Search ..... 345/87, 88, 89, 345/904

(56) References Cited

U.S. PATENT DOCUMENTS 5,764,710 A * 6/1998 Cheng et al. ..... 375/371
6,335,718 B1 * 1/2002 Hong et al. ..... 345/98
6,437,824 B1 * 8/2002 Suzuki et al. ..... 348/222.1
6,747,620 B2 * 6/2004 Jun ..... 345/87

* cited by examiner

*Primary Examiner*—Amare Mengistu
(74) *Attorney, Agent, or Firm*—McKenna Long & Aldridge LLP

(57) ABSTRACT

A liquid crystal display capable of diagnosing an abnormal driving state of a system and a liquid crystal display panel. In the liquid crystal display, a liquid crystal display panel has pixel cells arranged in a matrix pattern. A system supplies a timing synchronizing signal and video data. A timing controller generates timing control signals for driving the liquid crystal display panel in correspondence with the timing synchronizing signal inputted from the system, and re-arranges and outputs the input video data. A switching device generates a desired driving control signal. A self-diagnosing circuit applies a specific data to the liquid crystal display panel in response to the driving control signal. A driver is connected between the liquid crystal display panel and the timing controller to display the video data inputted from the timing controller on the liquid crystal display panel in correspondence with the control signals.

24 Claims, 7 Drawing Sheets

LIQUID CRYSTAL DISPLAY

This application claims the benefit of Korean Patent Application No. P2002-20151, filed on Apr. 12, 2002, which is hereby incorporated by reference for all purposes as if fully set forth herein.

BACKGROUND OF THE INVENTION

1. Field of the Invention

This invention relates to a liquid crystal display, and more particularly to a liquid crystal display capable of diagnosing abnormal driving states of systems and liquid crystal display panels.

2. Description of the Related Art

Generally, due to advantageous characteristics including small device dimensions and low power consumption, liquid crystal displays (LCDs) have been employed in notebook PCs, office automation equipment, audio/video equipment, etc. Particularly, active matrix liquid crystal displays using thin film transistors (TFTs) as switching devices may be suitable for displaying images dynamically.

FIG. 1 illustrates a schematic block diagram of a conventional LCD.

As shown in FIG. 1, an interface 10 receives data (e.g., RGB data) and control signals (e.g., an input clock signal, a horizontal synchronizing signal, a vertical synchronizing signal, and a data enable signal) inputted from a driving system such as a personal computer (not shown) and applies the data and control signals to a timing controller 12. A low voltage differential signal (LVDS) interface and a transistor transistor logic (TTL) interface are typically used in transmission of data and control signals from the driving system. The interface 10 and the timing controller 12 are usually integrated into a single chip.

The timing controller 12 uses the control signal inputted via the interface 10 to produce control signals suitable for driving a data driver 18 consisting of a plurality of data driver ICs (not shown) and a gate driver 20 consisting of a plurality of gate driver ICs (not shown). The timing controller 12 transfers the data signals from the interface 10 to the data driver 18.

A reference voltage generator 16 includes a digital-to-analog converter (DAC) and generates reference voltages used by the data driver 18. The reference voltages are established by a manufacturer on the basis of a transmissivity-to-voltage characteristic of the liquid crystal display panel. The data driver 18 selects reference voltages from input data in response to control signals from the timing controller 12 and applies the selected reference voltage to the liquid crystal display panel 2, thereby controlling a rotation angle of the liquid crystal. The gate driver 20 turns the thin film transistors (TFTs) arranged on the liquid crystal panel 2 on and off in response to the control signals inputted from the timing controller 12, and allows the analog image signals from the data driver 18 to be applied to each pixel connected to each TFT. A power voltage generator 14 supplies a driving voltage to each element, and generates a common electrode voltage of the liquid crystal display panel 2.

FIG. 2 illustrates a schematic block diagram showing a configuration of the timing controller in FIG. 1.

As shown in FIG. 2, the timing controller 12 includes a control signal generator 22 and a data signal generator 24. The timing controller 12 receives horizontal synchronizing signals, vertical synchronizing signals, data enable signals, clock and data (e.g., R,G,B data) signals. The vertical synchronizing signal represents a time required for displaying one frame field. The horizontal synchronizing signal represents a time required for displaying one line of the field. Thus, the horizontal synchronizing signal includes pulses corresponding to the number of pixels included in one line. The data enable signal represents a time required for supplying the pixel with a data.

The data signal generator 24 receives bits of data (e.g., R,G,B data) from the interface 10. The data signal generator 24 rearranges the data so that predetermined bits of data can be supplied to the data driver 18. The control signal generator 22 receives the horizontal synchronizing signal, the vertical synchronizing signal, the data enable signal and the clock signal from the interface 10, generates various control signals, and applies the various control signals to the data driver 18 and the gate driver 20.

Control signals required by the data driver 18 and the gate driver 20 will be described below. Herein, commonly used control signals, except for specially required signals, will only be described.

Control signals required by the data driver 18 include source sampling clock (SSC), source output enable (SOE), source start pulse (SSP), liquid crystal polarity reverse (POL) signals, etc. The SSC signal is used as a sampling clock signal for latching data in the data driver 18. The SSC signal determines a drive frequency of the data drive IC included in the data driver 18. The SOE signal allows data latched by the SSC signal to be transferred to the liquid crystal display panel 2. The SSP signal determines the initiation of a latch or sampling of the data during one horizontal synchronous period. The POL signal determines the polarity of the liquid crystal for the purpose of driving the liquid crystal display according to an inversion driving method.

Control signals required by the gate driver 20 include gate shift clock (GSC), gate output enable (GOE), gate start pulse (GSP) signals, etc. The GSC signal determines the on/off time of the gate of the TFT. The GOE signal controls an output of the gate driver 20. The GSP signal determines the first drive line of a field in one vertical synchronizing signal.

Control signals inputted to the data driver 18 and the gate driver 20 are generated from the timing controller 12 in response to control signals inputted from the interface 10. Thus, if any control signal is not inputted from the interface 10, then the timing controller 12 cannot generate any control signal. If, in conventional LCDs, control signals are not inputted from the interface 10 upon application of power, a picture cannot be displayed on the liquid crystal display panel.

Moreover, when conventional systems and/or liquid crystal display modules are abnormally driven to display an abnormal picture on the liquid crystal display panel, it is impossible to detect the cause of the abnormal operation.

SUMMARY OF THE INVENTION

Accordingly, it is an advantage of the present invention to provide a liquid crystal display capable of diagnosing abnormal driving states of systems and liquid crystal display panels.

In order to achieve these and other advantages of the invention, a liquid crystal display according to an embodiment of the present invention includes a liquid crystal display panel having pixel cells arranged in a matrix pattern; a system for applying a timing synchronizing signal and video data; a timing controller for generating timing control signals for driving the liquid crystal display panel in correspondence with the timing synchronizing signal inputted from the system and for rearranging and outputting the video data; a switching device for generating a desired driving control signal; a self-diagnosing circuit, included in the timing controller, for applying specific data to the liquid crystal display panel in response to the driving control signal; and a driver, connected between the liquid crystal display panel and the timing controller, for displaying video data inputted from the timing controller on the liquid crystal display panel in correspondence with the control signals.

The self-diagnosing circuit applies the specific data to the liquid crystal display panel when the driving control signal having an ON state is applied, irrespective of an input from the timing synchronizing signal.

The liquid crystal display further includes a control signal line connected between the self-diagnosing circuit and the system to apply the driving control signal to the self-diagnosing circuit.

The switching device is connected to the system to apply the driving control signal to the self-diagnosing circuit, via the control signal line.

The self-diagnosing circuit includes an oscillator for generating a free synchronizing signal having a desired frequency and applying the free synchronizing signal to the timing controller; a signal presence determiner for comparing the timing synchronizing signal with the free synchronizing signal and for generating a determining signal indicating whether the timing synchronizing signal is inputted; a control signal generator for generating a control signal on a basis of the free synchronizing signal, in response to a determining signal indicating no input of the timing synchronizing signal; a data storing unit for storing predetermined picture data and outputting the picture data to a driving circuit in response to a determining signal indicating no input of said timing synchronizing signal; and a self-diagnosis mode selector for selectively applying the timing synchronizing signal to the signal presence determiner in response to said driving control signal.

The switching device may be driven by a user and may be connected to the self-diagnosis mode selector to apply the driving control signal to the self-diagnosis mode selector.

The self-diagnosing circuit supplies predetermined picture data, different from said specific data, when the timing synchronizing signal indicates a no input state, when the driving control signal having an OFF state is applied.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENTS

Reference will now be made in detail to embodiments of the present invention, examples of which are illustrated in the accompanying drawings.

Figure 1:
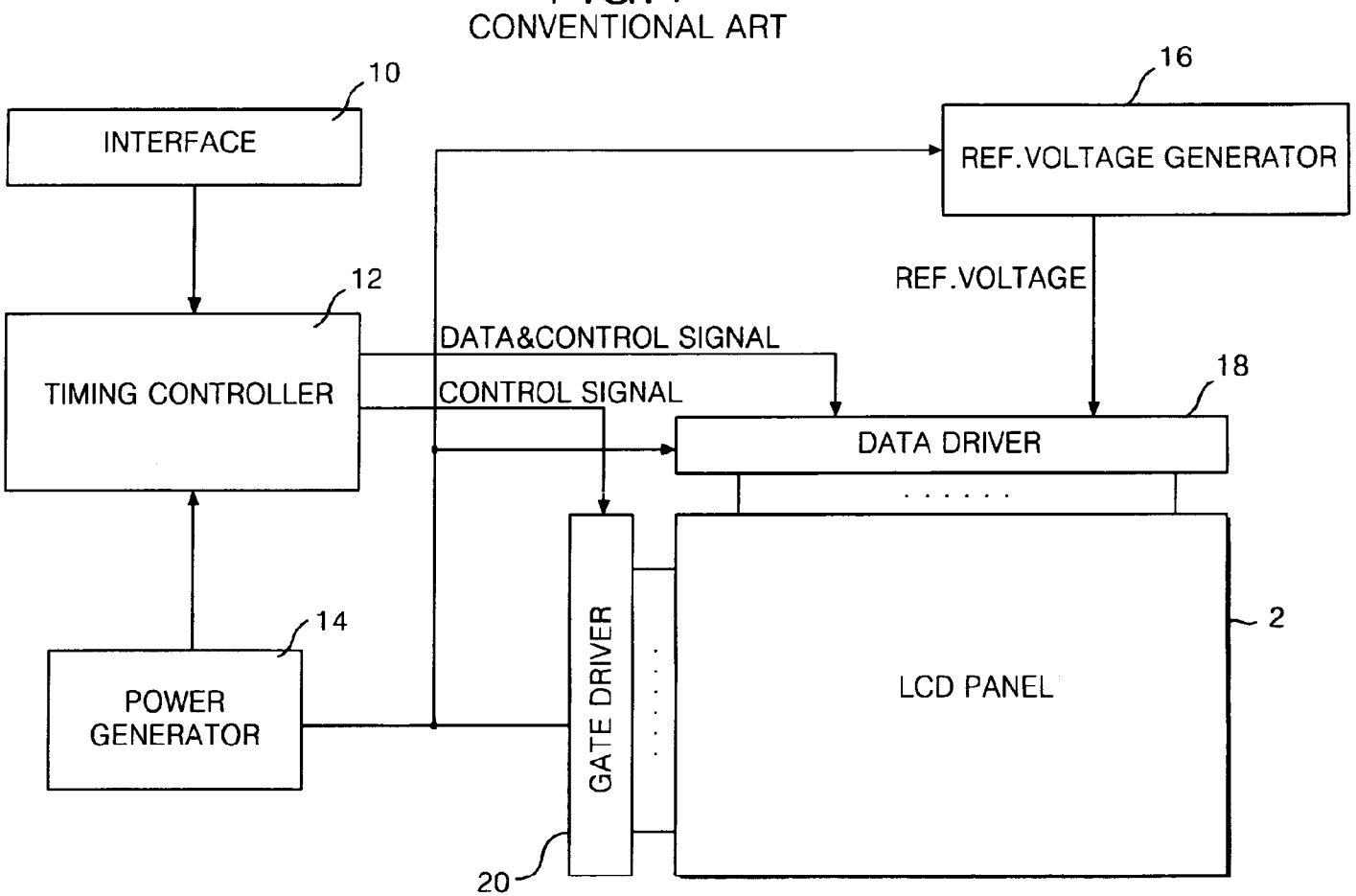
FIG.1 CONVENTIONAL ART
FIG. 1 illustrates a schematic block diagram of a conventional liquid crystal display.
Figure 2:
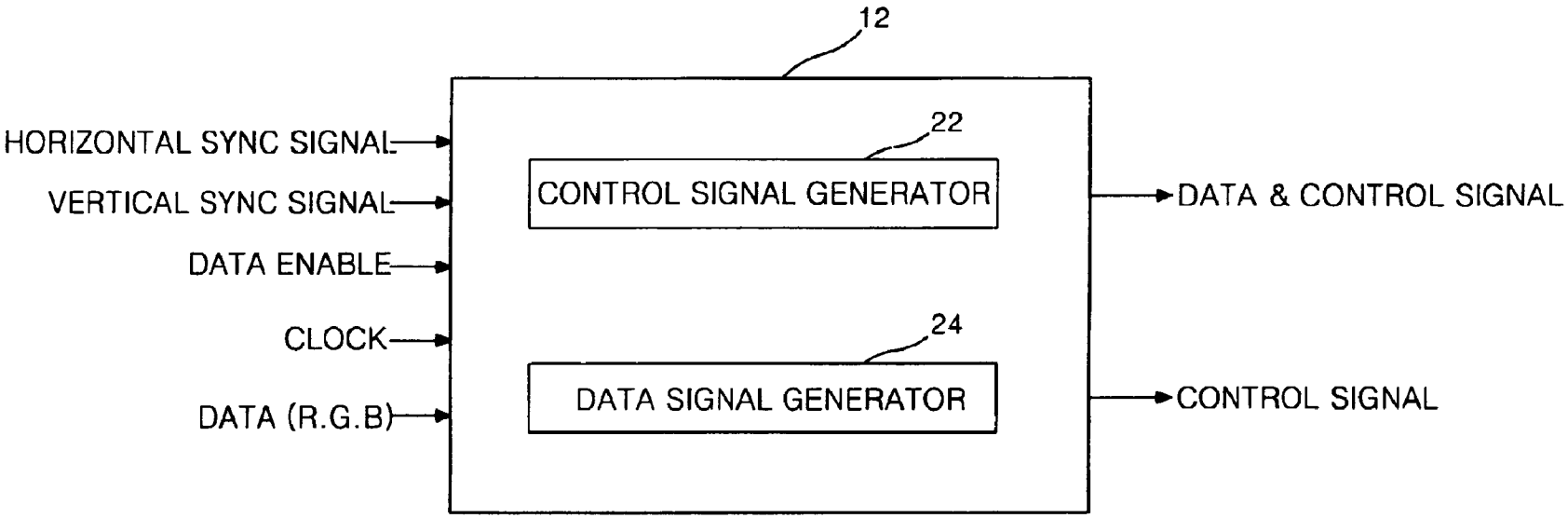
FIG.2 CONVENTIONAL ART
FIG. 2 illustrates a schematic block diagram of the timing controller in FIG. 1.
Figure 3:
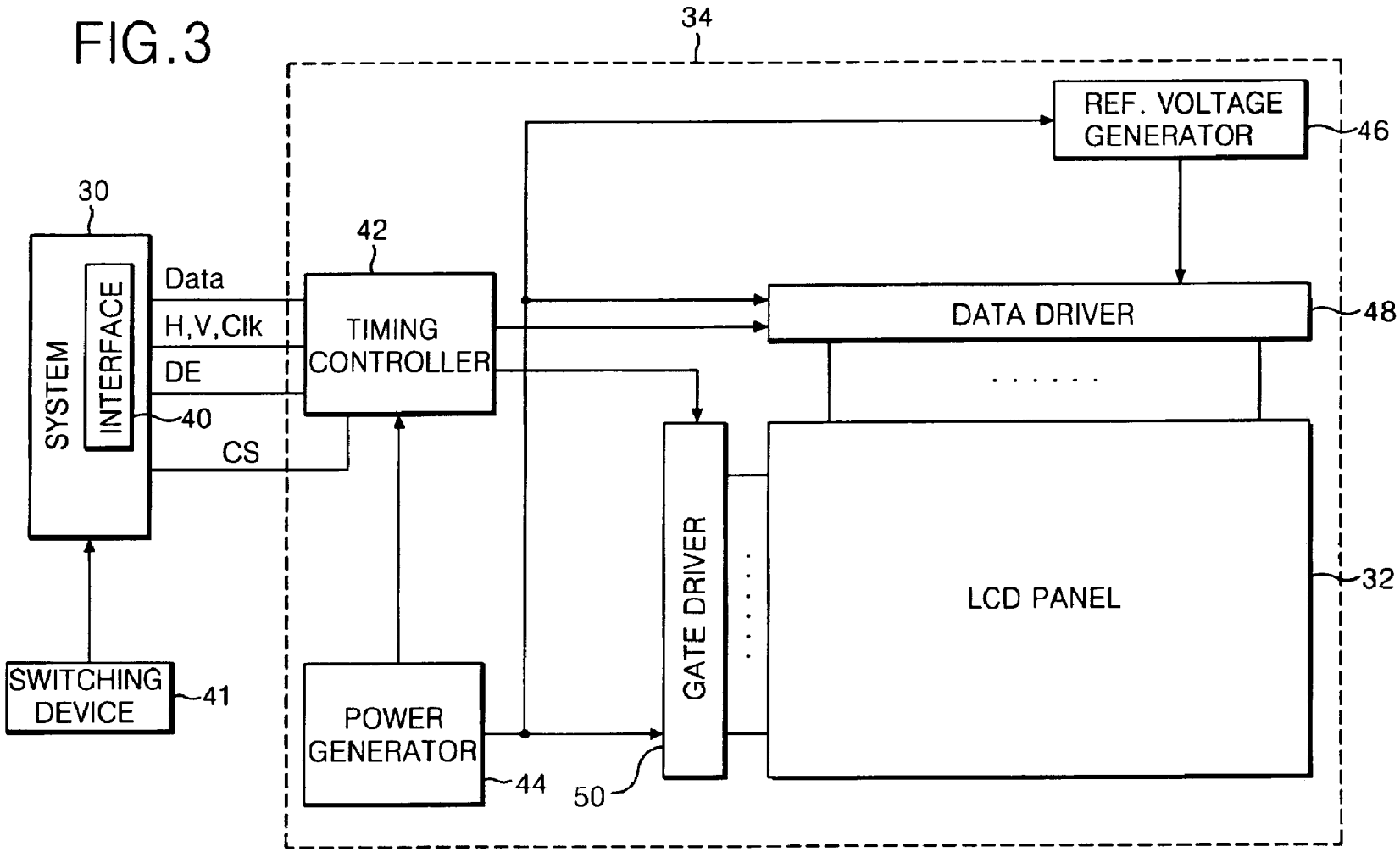
FIG. 3 illustrates a schematic block diagram of a liquid crystal display according to an embodiment of the present invention.

Referring to FIG. 3, there is shown a block diagram of a liquid crystal display (LCD) according to a first embodiment of the present invention.

The LCD includes a system 30 such as a notebook computer (not shown), an interface 40 for receiving video data (Data) and control signals (e.g., an input clock (CLK), a horizontal synchronizing signal (Hsync), a vertical synchronizing signal (Vsync), a data enable signal (DE), etc.) from the system 30 and applying them to a timing controller 42, a timing controller 42 for receiving control signals inputted from the interface 40 and generating control signals suitable in driving a data driver 48 consisting of a plurality of data driving ICs and a gate driver 50 consisting of a plurality of gate driving ICs and having a self-diagnosis function, a reference voltage generator 46 for applying a reference voltage to the data driver 48, and a self-diagnosing switching device 41 for applying an ON/OFF signal to turn a self-diagnosis function of the timing controller 42 on or off. The self-diagnosis function of the timing controller 42 acts to diagnose a driving state of the system 30 or of the liquid crystal display module 34 when either an abnormal picture or no picture is displayed on the liquid crystal display panel 32. The timing controller 42 may diagnose a state of the control signals from the system 30 in addition to a power application and receiving state.

The system 30 may use a video chip, a video controller, a CPU, etc. (not shown), to generate video data (Data) and control signals (e.g., input clock (CLK), horizontal synchronizing signal (Hsync), vertical synchronizing signal (Vsync), data enable signal (DE), etc.).

The self-diagnosing switching device 41 may be activated by a function key located at one side of the lower frame formed at a notebook computer (e.g., a keyboard pattern). Alternatively, self-diagnosing switching device 41 may be provided at one side of the upper frame mounted with the liquid crystal display panel 32. The self-diagnosing switching device 41 applies a self-diagnosis switching signal (CS) as a signal indicating an ON/OFF state to the timing controller 42 in response to an operation of a user, via the system 30. The voltage associated with the ON/OFF state of the self-diagnosis switching signal (CS) may be a specific voltage (e.g., 5V, 3.3V, or 0V) and may be expressed as a logical level of '1' (high) or '0' (low).

The interface 40 receives the video data and control signals inputted from the video chip and applies them to the timing controller 12. Low voltage differential signal (LVDS) interfaces, transistor transistor logic (TTL) interfaces, and simple connectors may be used for data and control signal transmission from the system 30. Such interfaces, along with the timing controller 42, may be integrated into a single chip.

A self-diagnosis control signal line for applying a self-diagnosis switching signal (CS) from the self-diagnosis switching device 41 to the timing controller 42 connects the system 30 and the liquid crystal display module 34. The LCD according to another aspect of the present invention includes providing the self-diagnosis control signal line in the LVDS interface without a separate self-diagnosis signal line transferring a self-diagnosis switching signal (CS) to the timing controller 42.

The data driver 48 selects reference voltages from input data in response to control signals inputted from the timing controller 42 and applies the selected reference voltages to the liquid crystal display panel 32, thereby controlling a rotation angle of a liquid crystal.

The reference signal generator 46 includes a digital-to-analog converter (DAC) and generates reference voltages used by the data driver 48. The reference voltages are established by a manufacturer on the basis of a transmittance-to-voltage characteristic of the liquid crystal display panel.

The gate driver 50 turns the TFTs arranged within the liquid crystal display panel 32 on and off in response to control signals from the timing controller 42 and allows analog image signals inputted from the data driver 48 to be applied to pixels connected to the TFTs. The power generator 44 supplies an operating voltage for each element and generates a common electrode voltage for the liquid crystal display panel 32.

Figure 4:
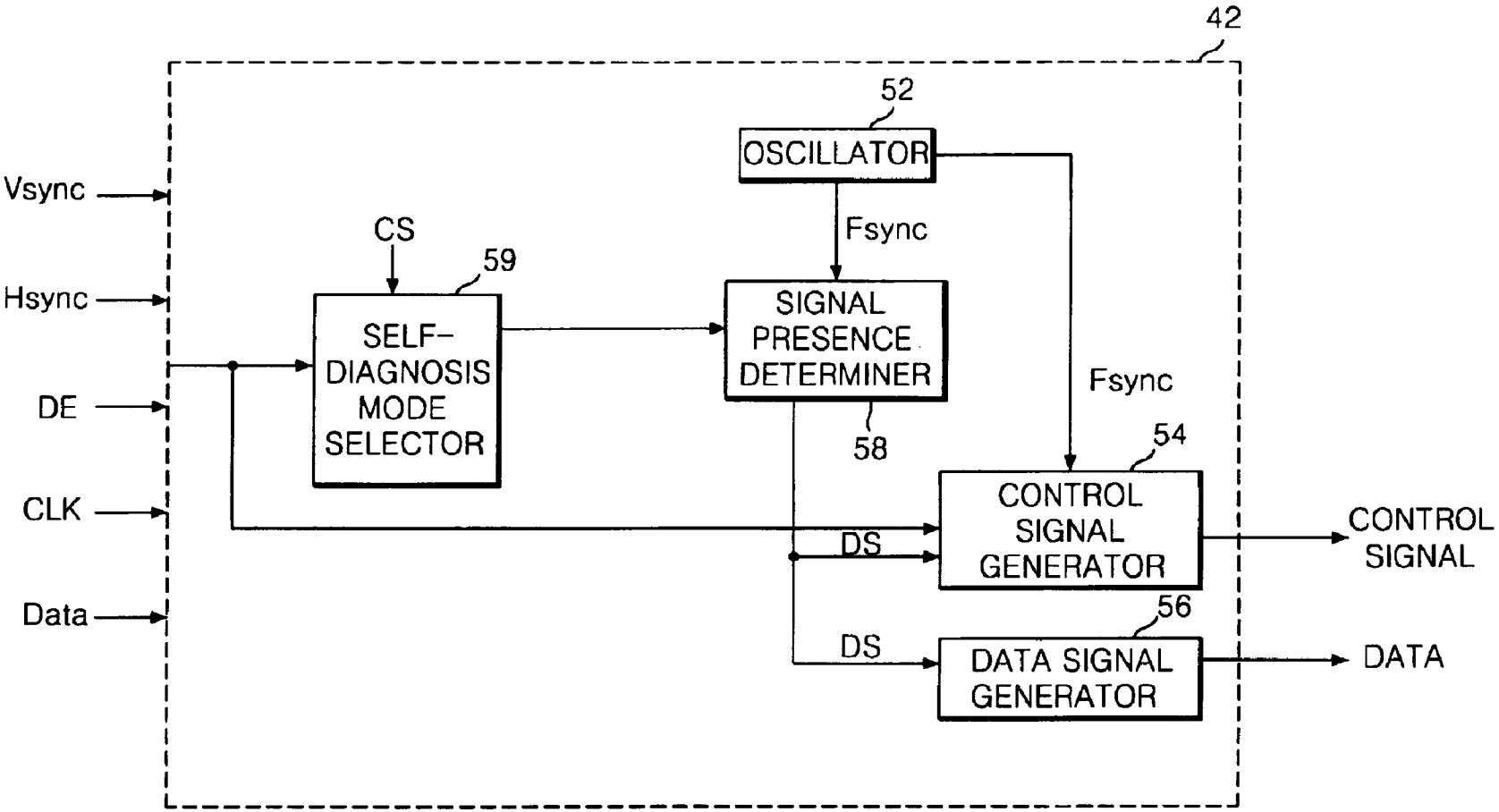
FIG. 4 illustrates a schematic block diagram of the timing controller in FIG. 3.

FIG. 4 illustrates a schematic block diagram of the timing controller of FIG. 3. Referring to FIG. 4, the timing controller 42 includes a control signal generator 54 for receiving timing synchronizing signals (e.g., horizontal synchronizing signals (Hsync), vertical synchronizing signals (Vsync), data enable signals (DE), clock signals (CLK), etc.) from a video chip and outputting control signals to the data driver 48 and the gate driver 50, a data signal generator 56 for receiving video data inputted from the video chip and outputting the received video data to the data driver 48, a self-diagnosis mode selector 59 for activating a self-diagnosis mode within the timing controller 42 in response to a self-diagnosis switching signal (CS) inputted by a self-diagnosis switching device 41 via the system 30, a signal presence determiner 58 for monitoring an application of various control signals inputted from the video chip in response to the self-diagnosis mode selector 59, and an oscillator 52 for applying a predetermined frequency of a free-synchronizing signal (Fsync) to the signal presence determiner 58.

Referring still to FIG. 4, the control signal generator 54 receives the horizontal synchronizing signal (Hsync), the vertical synchronizing signal (Vsync), the data enable signal (DE) and the clock signal (CLK) from the video chip, generates various control signals for driving the liquid crystal display panel 32, and applies the generated control signals to the data driver 48 and the gate driver 50. For example, the control signal generator 54 generates source sampling clock (SSC), source output enable (SOE), source start pulse (SSP), liquid crystal polarity reverse (POL) signals, etc., on a basis of an input vertical synchronizing signal and applies them to the data driver 48. Further, the control signal generator 54 generates gate shift clock (GSC), gate output enable (GOE), gate start pulse (GSP) signals, etc., on a basis of an input vertical synchronizing signal and applies them to the gate driver 50. The control signal generator 54 may apply the abovementioned control signals on a basis of the data enables signal (DE).

Referring still to FIG. 4, the data signal generator 56 receives video data from the video chip and rearranges the video data so that the received data may be applied to the liquid crystal display panel 32 via the data driver 48. The data signal generator 56 stores specific data for displaying a predetermined picture for more than at least one frame irrespective of the video data supplied from the video chip. Accordingly, ROM, external flesh memory, etc., may be used as storing means integrated into the data signal generator 56 within the timing controller 42.

Referring to FIG. 4, the oscillator 52 generates a predetermined reference clock signal, performs a frequency division of the reference clock signal, and applies the frequency divided reference clock signal to the signal presence determiner 58 as a free-synchronizing signal (Fsync). The applied free-synchronizing signal has the same frequency as the vertical synchronizing signal Vsync. The oscillator 52 may be provided at either the exterior or the interior of the timing controller 42.

Still referring to FIG. 4, the self-diagnosis mode selector 59 outputs the vertical synchronizing signal (Vsync) or the data enable signal (DE) applied from the video chip to the signal presence determiner 58 in response to the self-diagnosis switching signal (CS) applied from the self-diagnosing switching device 41, via the system 30. The self-diagnosis mode selector 59 sets the timing controller 42 to a self-diagnosis mode when the self-diagnosis switching signal (CS) having an ON state is applied from the self-diagnosing switching device 41, via the system 30. The self-diagnosis mode selector 59 sets the timing controller 42 to a normal driving mode when the self-diagnosis switching signal (CS) having an OFF state is applied from the self-diagnosing switching device 41, via the system 30. Accordingly, if a self-diagnosis switching signal (CS) having an ON state is inputted, the self-diagnosis mode selector 59 does not output the vertical synchronizing signal (Vsync) or the data enable signal (DE) to the signal presence determiner 58. If a self-diagnosis switching signal (CS) having an OFF state is inputted, the self-diagnosis mode selector 59 outputs the vertical synchronizing signal (Vsync) or the data enable signal (DE) to the signal presence determiner 58.

A method of driving the timing controller 42 according to a normal driving mode of the first embodiment will be described.

First, in driving the timing controller 42 according to a normal driving mode, input states of control signals to the timing controller 42 are determined in order to display pattern signals including full black, full white, or specific characters on the liquid crystal display panel 32 when no input signal is applied. More specifically, a self-diagnosis switching signal (CS) having an OFF state from the self-diagnosing switching device 41 may be applied to the self-diagnosis mode selector 59 having an OFF state, via the system 30. Accordingly, the vertical synchronizing signal (Vsync) or the data enable signal (DE) applied to the timing controller may be inputted to the signal presence determiner 58.

The signal presence determiner 58 monitors control signals inputted from the video chip, via the interface 40 and the self-diagnosis mode selector 59. A process of operating the signal presence determiner 58 will be described in detail with reference to FIG. 5 below.

Figure 5:
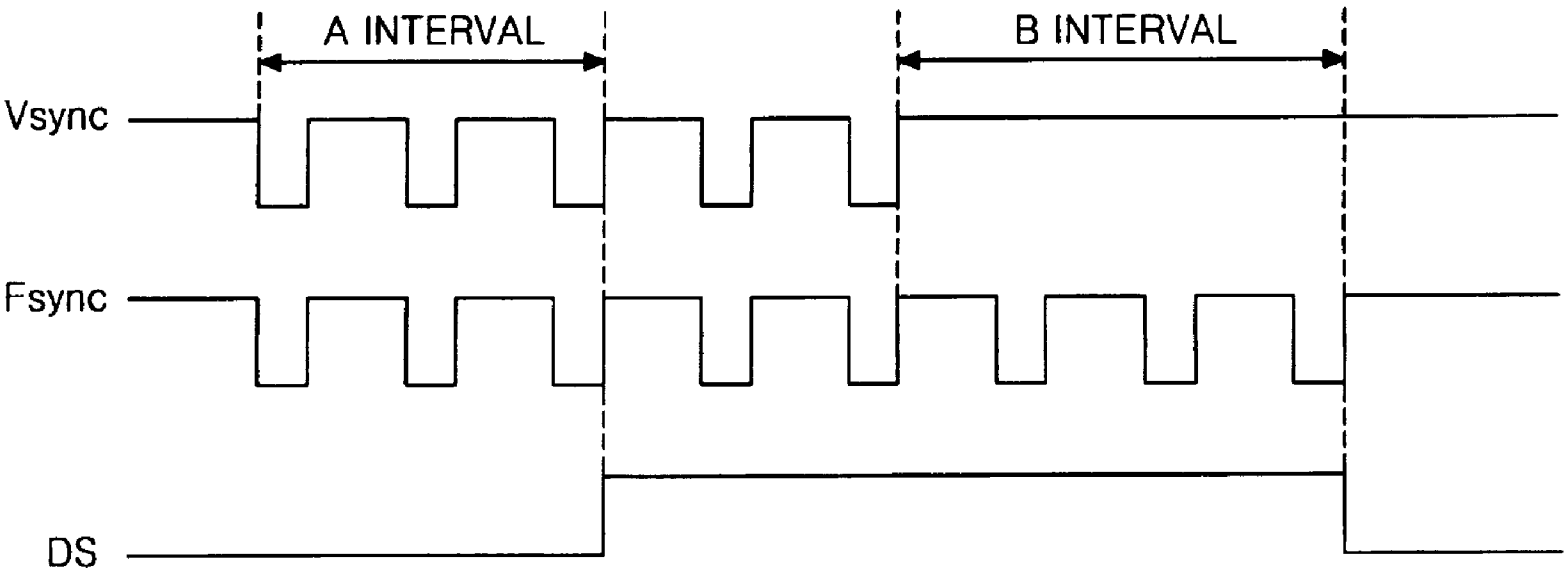
FIG. 5 illustrates a waveform diagram representing a generation process of a determining signal from the signal presence determiner shown in FIG. 4.

As shown in FIG. 5, a vertical synchronizing signal (Vsync) or a data enable signal (DE) having an exemplary frequency of 60 Hz may be used as a reference signal inputted from the video chip, via the interface 40.

As shown in FIG. 5, the signal presence determiner 58 receives the reference signal (e.g., the vertical synchronizing signal (Vsync)) from the video chip, via the interface 40 and further receives a free synchronizing signal (Fsync) having the same frequency as the reference signal (e.g., 60 Hz). Having received the reference signal and the free synchronizing signal (Fsync), the signal presence determiner 58 compares the reference signal with the free synchronizing signal (Fsync) in the A INTERVAL of time shown in FIG. 5. If the reference signal is inputted during a predetermined period (e.g., three periods), a determining signal (DS) having a high state is applied to indicate an effective signal input to the control signal generator 54. Having received the high state of determining signal (DS), the control signal generator 54 receives the vertical synchronizing signal (Vsync) or the data enable signal (DE) applied from the video chip, via the interface 40.

While still referring to FIG. 5, the signal presence determiner 58 compares the reference signal (e.g., vertical synchronizing signal (Vsync)) with the free synchronizing signal (Fsync) in the B INTERVAL of time. If the reference signal is not inputted during a predetermined period (e.g., three periods), a determining signal having a low state is applied to the control signal generator 54. Having received the low state determining signal, the control signal generator 54 receives the free synchronizing signal (Fsync) from the oscillator 52 to display a pattern signal including full black, full white, or specific character signals on the liquid crystal display panel 32.

Figure 6:
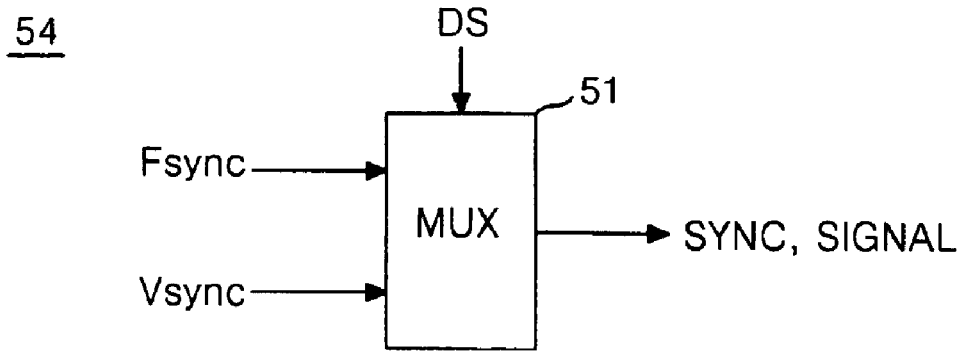
FIG. 6 illustrates a multiplexer provided at a control signal generator of the timing controller shown in FIG. 4.

As shown in FIG. 6, the control signal generator 54 includes a multiplexor (MUX) 51. The MUX 51 receives the free synchronizing signal (Fsync), the reference signal (e.g., the vertical synchronizing signal (Vsync) or the data enable signal (DE)), and the determining signal (DS), and selects the free synchronizing signal (Fsync) or the reference signal as a synchronizing signal used in correspondence with an input state of the determining signal (DS), and outputs the synchronizing signal. The MUX 51 selects the reference signal (e.g., vertical synchronizing signal (Vsync)) when a high state determining signal is inputted while the MUX 51 selects the free synchronizing signal (Fsync) when a low state determining signal is inputted. Referring back to FIG. 5, the control signal generator 54 generates and outputs control signals on the basis of the reference signal (e.g., vertical synchronizing signal (Vsync)) or the free synchronizing signal (Fsync) outputted from the MUX 51.

Still referring to FIG. 5, the data signal generator 56 outputs pattern signals including full black, full white or, specific character information stored in advance when a low state determining signal is inputted in correspondence with an input state of the determining signal.

A self-diagnosis mode of driving the timing controller 42 will be described below. In the self-diagnosis mode of driving the timing controller 42, control signals are generated irrespective of control signals inputted to the timing controller 42. Accordingly, the control signals are provided to display specific pattern signals capable of diagnosing a driving state of the liquid crystal display panel 32. Such pattern signals include full black, full white, full red, full green, full blue, or signals that generate specific characters, different from data displayed during a normal mode of driving the timing controller 42. In order to diagnose all of the driving states of the liquid crystal display panel 32, a plurality of specific pattern signals may be displayed continuously in a predetermined sequence.

More specifically, in the self-diagnosis mode of driving the timing controller 42, the self-diagnosis switching signal (CS) having an ON state from the self-diagnosing switching device 41 is applied to the self-diagnosis mode selector 59, via the system 30. This prevents the vertical synchronizing signal (Vsync) or the data enable signal (DE) applied to the timing controller 42 from being applied to the control signal generator 54. Accordingly, the self-diagnosis switching signal (CS) having an ON state applied from the self-diagnosing switching device 41 is generated by a user when abnormal data is displayed on the liquid crystal display panel 32. The abnormal data may be displayed when power is applied to the LCD module or when a user intends to diagnose a driving state of the liquid crystal display panel 32 and the system 30.

The MUX 51 within the control signal generator 54 receives a low state determining signal (DS) from the signal presence determiner 58 and receives the free synchronizing signal (Fsync) and the vertical synchronizing signal (Vsync) or the data enable signal (DE) from the video chip. Thus, the MUX 51 of the control signal generator 54 selects and then outputs the free synchronizing signal (Fsync). Having received the free synchronizing signal (Fsync) from the MUX 51, the control signal generator 54 generates and outputs control signals on a basis of the free synchronizing signal (Fsync). Accordingly, the data signal generator 56 displays specific pattern signals stored in advance and is capable of diagnosing a driving state of the liquid crystal display panel 32 such as pattern signals including full black, full white, full red, full green, full blue or specific characters for more than at least one frame. In order to entirely diagnose a driving state of the liquid crystal display panel 32, a plurality of specific pattern signals may be displayed continuously in a predetermined sequence.

Since the liquid crystal display module 34 undergoes normal operation while the timing controller 42 performs the self-diagnosis mode to display specific pattern signals capable of diagnosing a driving state of the liquid crystal display panel 32 (e.g., pattern signals including full black, full white, full red, full green, full blue or specific characters), the liquid crystal display module 34 is diagnosed in a normal state while the system 30 is diagnosed as an abnormal state. Accordingly, the self-diagnosis function of the timing controller 42 is controlled via the system 30 and depends upon whether or not a picture that is displayed on the liquid crystal display panel 32 has an abnormal state. Accordingly, a user can easily detect an abnormal driving state within the liquid crystal display module 34 or the system 30.

In the course of displaying a normal picture on the liquid crystal display panel 32, abnormal data (e.g., patterns including full black, full white, or specific characters) may be displayed on the liquid crystal display panel 32. Accordingly, a user may operate the self-diagnosing switching device 41 to apply the self-diagnosis switching signal (CS) having an ON state to the timing controller 42 in order to detect an abnormal driving state of the liquid crystal display module 34 and the system 30. The self-diagnosis switching signal (CS) having an ON state from the self-diagnosing switching device 41 allows the timing controller 42 to be set to a self-diagnosis mode, thereby performing a self-diagnosis of the liquid crystal display module 34 and the system 30 as mentioned above. Accordingly, users can cope with abnormal driving states of the liquid crystal display module 34 and/or the system 30 in conformity to the self-diagnosis result.

Figure 7:
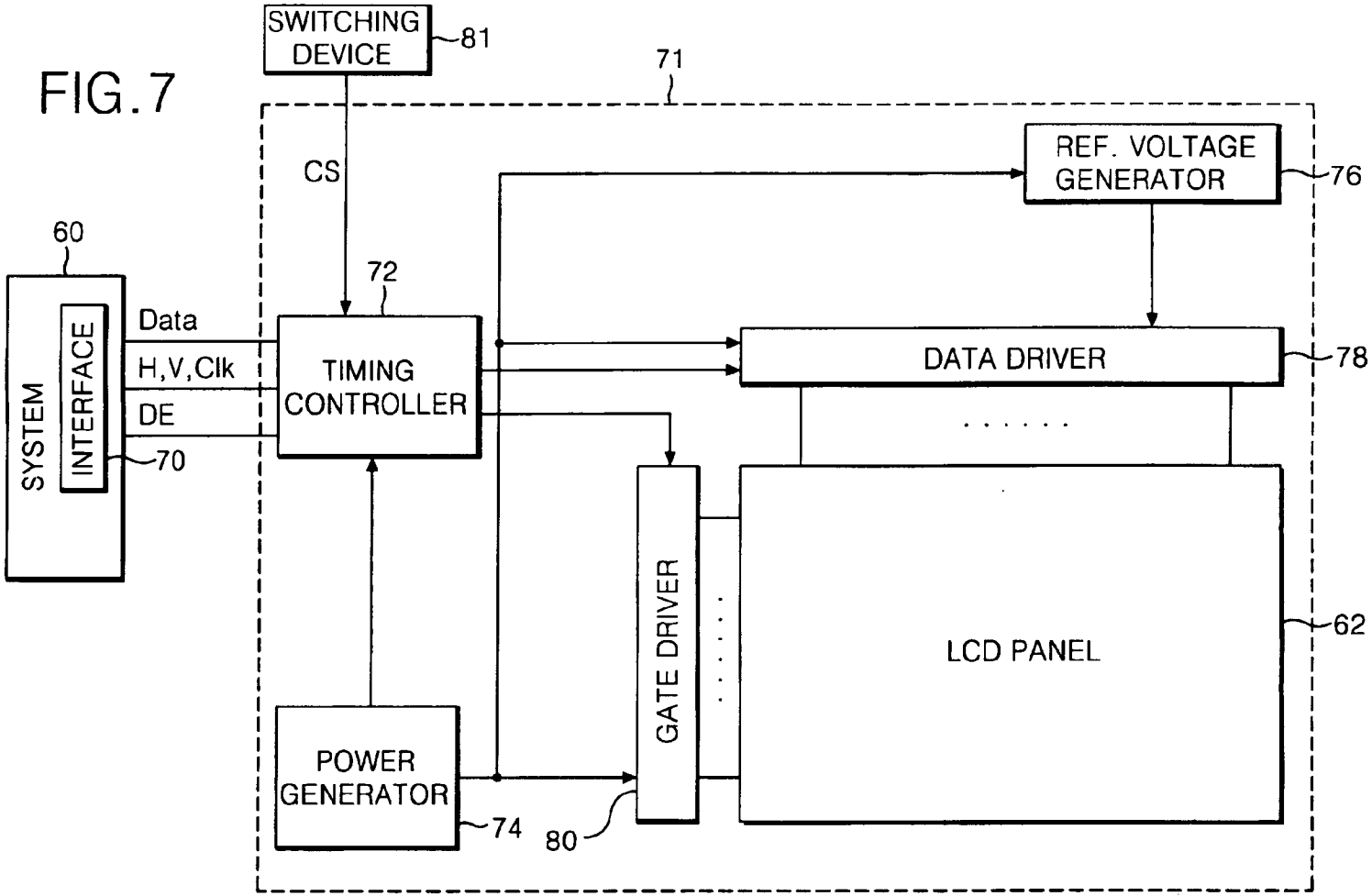
FIG. 7 illustrates a schematic block diagram of a liquid crystal display according to another embodiment of the present invention.

Referring now to FIG. 7, there is shown a liquid crystal display (LCD) according to a second embodiment of the present invention.

The LCD includes a system 60 such as a notebook computer (not shown), an interface 70 for receiving video data (Data) and control signals (e.g., an input clock (CLK), a horizontal synchronizing signal (Hsync), a vertical synchronizing signal (Vsync), a data enable signal (DE), etc.) from the system 60 and applying them to a timing controller 72, a timing controller 72 for receiving control signals inputted from the interface 70 and generating control signals suitable for driving a data driver 78 consisting of a plurality of data driving ICs and a gate driver 80 consisting of a plurality of gate driving ICs and having a self-diagnosis function, a reference voltage generator 76 for applying a reference voltage to the data driver 78, and a self-diagnosing switching device 81 for applying an ON/OFF signal to turn a self-diagnosis function of the timing controller 72 on or off. The self-diagnosis function of the timing controller 72 acts to diagnose a driving state of the system 60 or of the liquid crystal display module 71 when either an abnormal picture or no picture is displayed on the liquid crystal display panel 62. The timing controller 72 may diagnose a state of the control signals from the system 60 in addition to a power application and receiving state.

The system 60 may use a video chip, a video controller, a CPU, etc. (not shown), to generate video data (Data) and control signals (e.g., an input clock (CLK), horizontal synchronizing signal (Hsync), vertical synchronizing signal (Vsync), data enable signal (DE), etc.).

The self-diagnosing switching device 81 may be activated by a function key located at one side of the lower frame formed at a notebook computer (e.g., a keyboard pattern). Alternatively, self-diagnosing switching device 81 may be provided at one side of the upper frame mounted with the liquid crystal display panel 32. The self-diagnosing switching device 81 applies a self-diagnosis switching signal (CS) as a signal indicating an ON/OFF state to the timing controller 72 in response to an operation of a user, via the system 60. The voltage associated with the ON/OFF state of the self-diagnosis switching signal (CS) may be a specific voltage (e.g., 5V, 3.3V, or 0V) and may be expressed as a logical level of '1' (high) or '0' (low).

The interface 70 receives the video data and control signals inputted from the video chip and applies them to the timing controller 72. Low voltage differential signal (LVDS) interfaces, a transistor transistor logic (TTL) interfaces, and simple connectors may be used for data and control signal transmission from the system 60. Such interfaces, along with the timing controller 72 may be integrated into a single chip.

The data driver 78 selects reference voltages from input data in response to control signals inputted from the timing controller 72 and applies the selected reference voltages to the liquid crystal display panel 62, thereby controlling a rotation angle of a liquid crystal.

The reference signal generator 76 includes a digital-to-analog converter (DAC) and generates reference voltages used by the data driver 78. The reference voltages are established by a manufacturer on the basis of a transmittance-to-voltage characteristic of the liquid crystal display panel.

The gate driver 80 turns the TFTs arranged within the liquid crystal display panel 62 on and off in response to control signals from the timing controller 72 and allows analog image signals inputted from the data driver 78 to be applied to pixels connected to the TFTs. The power generator 74 supplies an operating voltage for each element and generates a common electrode voltage for the liquid crystal display panel 62.

Similar to the timing controller 42 illustrated in FIG. 4, the timing controller 72 includes a timing signal generator for receiving timing synchronizing signals (e.g., horizontal synchronizing signals (Hsync), vertical synchronizing signal (Vsync), data enable signals (DE), clock signals (CLK), etc.) from a video chip and outputting control signals to the data driver 78 and the gate driver 80, a data signal generator for receiving a video data inputted from the video chip and outputting the received video data to the data driver 78, a self-diagnosis mode selector for activating a self-diagnosis mode within the timing controller 72 in response to a self-diagnosis switching signal (CS) inputted via a self-diagnosing switching device 81, a signal presence determiner for monitoring an application of various control signals inputted from the video chip in response to the self-diagnosis mode selector, and an oscillator for applying a predetermined frequency of a free-synchronizing signal (Fsync) to the signal presence determiner.

Similar to that illustrated in FIG. 4, the control signal generator according to the second embodiment of the present invention receives horizontal synchronizing signals (Hsync), vertical synchronizing signals (Vsync), data enable signals (DE) and clock signals (CLK) from the video chip to generate and output various control signals for driving the liquid crystal display panel 62. The control signal generator then applies the generated control signals to the data driver 78 and the gate driver 80. For example, the control signal generator generates source sampling clock (SSC), source output enable (SOE), source start pulse (SSP), liquid crystal polarity reverse (POL) signals, etc. on a basis of an input vertical synchronizing signal and applies them to the data driver 78. Further, the control signal generator generates gate shift clock (GSC), gate output enable (GOE), gate start pulse (GSP) signals, etc. on a basis of an input vertical synchronizing signal applies them to the gate driver 80. At this time, the control signal generator may apply the above-mentioned control signals on a basis of the data enables signal (DE).

Similar to the data signal generator 56 illustrated in FIG. 4, the data signal generator according to the second embodiment of the present invention receives a video data from the video chip and re-arranges the video data so that the received data may be applied to the liquid crystal display panel 62 via the data driver 78. The data signal generator stores specific data for displaying a predetermined picture for more than at least one frame irrespective of the video data supplied from the video chip. Accordingly, a ROM, external flash memory, etc., may be used as storing means integrated into the data signal generator within the timing controller 72.

Similar to the oscillator 52 illustrated in FIG. 4, the oscillator according to the second embodiment of the present invention generates a predetermined reference clock signal, performs a frequency division of the reference clock signal, and applies the frequency divided reference clock signal to the signal presence determiner as a free-synchronizing signal (Fsync). The applied free-synchronizing signal has the same frequency as the vertical synchronizing signal Vsync. The oscillator may be provided at either the exterior or the interior of the timing controller 72.

In the second embodiment of the present invention, the self-diagnosis mode selector outputs the vertical synchronizing signal (Vsync) or the data enable signal (DE) applied from the video chip to the signal presence determiner in response to the self-diagnosis switching signal (CS) applied from the self-diagnosing switching device 81. The self-diagnosis mode selector sets the timing controller 72 to a self-diagnosis mode when the self-diagnosis switching signal (CS) having an ON state is applied from the self-diagnosing switching device 81. The self-diagnosing switching device 81 sets the timing controller 72 to a normal driving mode when the self-diagnosis switching signal (CS) having an OFF state is applied from the self-diagnosing switching device 81. Accordingly, if a self-diagnosis switching signal (CS) having an ON state is inputted, the self-diagnosis mode selector does not output the vertical synchronizing signal (Vsync) or the data enable signal (DE) to the signal presence determiner. If a self-diagnosis switching signal (CS) having an OFF state is inputted, the self-diagnosis mode selector outputs the vertical synchronizing signal (Vsync) or the data enable signal (DE) to the signal presence determiner.

A method of driving the timing controller 72 according to a normal driving mode of the second embodiment will be described.

First, in driving the timing controller 72 according to a normal driving mode, input states of control signals to the timing controller 72 are determined in order to display pattern signals including full black, full white or specific characters on the liquid crystal display panel 62 when no input signal is applied. More specifically, a self-diagnosis switching signal (CS) having an OFF state from the self-diagnosing switching device 81 may be applied to the self-diagnosis mode selector. Accordingly, the vertical synchronizing signal (Vsync) or the data enable signal (DE) applied to the timing controller 72 may be inputted to the signal presence determiner.

The signal presence determiner monitors control signals inputted from the video chip, via the interface 70 and the self-diagnosis mode selector. A process of operating the signal presence determiner will be described in detail below.

Similarly to the process illustrated in FIG. 5, but with respect to the second embodiment of the present invention, a vertical synchronizing signal (Vsync) a data enable signal (DE) having an exemplary frequency of 60 Hz may be used as a reference signal inputted from the video chip, via the interface 70.

The signal presence determiner receives the reference signal (e.g., the vertical synchronizing signal (Vsync)) from the video chip, via the interface 40 and further receives a free synchronizing signal (Fsync) having the same frequency as the reference signal (e.g., 60 Hz). Having received the reference signal and the free synchronizing signal (Fsync), the signal presence determiner compares the reference signal with the free synchronizing signal (Fsync) in the aforementioned A INTERVAL of time during which period of time, the reference signal is firstly inputted. If the reference signal is inputted during a predetermined period (e.g., three periods), a determining signal (DS) having a high state is applied for indicating an effective signal input to the control signal generator. Having received the high state of determining signal (DS), the control signal generator receives the vertical synchronizing signal (Vsync) or the data enable signal (DE) applied from the video chip, via the interface 70.

Alternately, if, when the signal presence determiner compares the reference signal (e.g., vertical synchronizing signal (Vsync)) with the free synchronizing signal (Fsync) in the aforementioned B INTERVAL of time, the reference signal is not inputted during a predetermined period (e.g., three periods), a determining signal having a low state is applied to the control signal generator. Having received the low state determining signal, the control signal generator receives the free synchronizing signal (Fsync) from the oscillator to display a pattern signal including full black, full white or specific character signals on the liquid crystal display panel 62.

The control signal generator in the second embodiment of the present invention includes a multiplexor (MUX) as shown in FIG. 6. The MUX receives the free synchronizing signal (Fsync), the reference signal (e.g., the vertical synchronizing signal (Vsync) or the data enable signal (DE)), and the determining signal (DS), and selects the free synchronizing signal (Fsync) or the reference signal as a synchronizing signal used in correspondence with an input state of the determining signal (DS), and outputs the synchronizing signal. At this time, the MUX selects the reference signal (e.g., vertical synchronizing signal (Vsync)) when a high state determining signal is inputted while the MUX selects the free synchronizing signal (Fsync) when a low state determining signal is inputted. The control signal generator generates and outputs control signals on the basis of the reference signal (e.g., vertical synchronizing signal (Vsync)) or the free synchronizing signal (Fsync) outputted from the MUX.

Similar to first embodiment of the invention disclosed herein, the data signal generator in the second embodiment of the present invention outputs pattern signals including full black, full white or, specific character information stored in advance on the liquid crystal display panel 62 when a low state determining signal is inputted in correspondence with an input state of the determining signal.

A self-diagnosis mode of driving the timing controller 72 will be described below. In the self-diagnosis mode of driving the timing controller 72, control signals are generated irrespective of control signals inputted to the timing controller 72. Accordingly, the control signals are provided to display specific pattern signals capable of diagnosing a driving state of the liquid crystal display panel 62. Such pattern signals include full black, full white, full red, full green, full blue or signals that generate specific characters, different from data displayed during a normal mode of driving the timing controller 72. In order to diagnose all of the driving states of the liquid crystal display panel 72, a plurality of specific pattern signals may be displayed continuously in a predetermined sequence.

More specifically, in the self-diagnosis mode of driving the timing controller 72, the self-diagnosis switching signal (CS) having an ON state from the self-diagnosing switching device 81 is applied to the self-diagnosis mode selector. This prevents the vertical synchronizing signal (Vsync) or the data enable signal (DE) applied to the timing controller 72 from being applied to the control signal generator. Accordingly, the self-diagnosis switching signal (CS) having an ON state applied from the self-diagnosing switching device 81 is generated by a user when an abnormal data is displayed on the liquid crystal display panel 62. The abnormal data may be displayed when power is applied to the LCD module or when a user intends to diagnose a driving state of the liquid crystal display panel 62 and the system 60.

In the second embodiment of the present invention, the MUX of the control signal generator receives a low state determining signal (DS) from the signal presence determiner and receives the free synchronizing signal (Fsync) and the vertical synchronizing signal (Vsync) or the data enable signal (DE) from the video chip. Thus, the MUX of the control signal generator selects and then outputs the free synchronizing signal (Fsync). Having received the free synchronizing signal (Fsync) from the MUX, the control signal generator generates and outputs control signals on a basis of the free synchronizing signal (Fsync). Accordingly, the data signal generator displays specific pattern signals stored in advance and capable of diagnosing a driving state of the liquid crystal display panel 62 such as pattern signals including full black, full white, full red, full green, full blue or specific character for more than at least one frame on the liquid crystal display panel 62. In order to entirely diagnose a driving state of the liquid crystal display panel 62 a plurality of specific pattern signals may be displayed continuously in a predetermined sequence.

Since the liquid crystal display module 71 undergoes a normal operation while the timing controller 72 performs the self-diagnosis mode to display specific pattern signals capable of diagnosing a driving state of the liquid crystal display panel 62 (e.g., pattern signals including full black, full white, full red, full green, full blue or specific characters), the liquid crystal display module 71 is diagnosed in a normal state while the system 60 is diagnosed as an abnormal state. Accordingly, the self-diagnosis function of the timing controller 72 is controlled via the system 60 and depends upon whether or not a picture that is displayed on the liquid crystal display panel 62 has an abnormal state. Accordingly, a user can easily detect an abnormal driving state within the liquid crystal display module 71 or the system 60.

In the course of displaying a normal picture on the liquid crystal display panel 62, abnormal data (e.g., patterns including full black, full white, or specific characters) may be displayed on the liquid crystal display panel 62. Accordingly, a user may operate the self-diagnosing switching device 81 to apply the self-diagnosis switching signal (CS) having an ON state to the timing controller 72 in order to detect an abnormal driving state of the liquid crystal display module 71 and the system 60. The self-diagnosis switching signal (CS) having an ON state from the self-diagnosing switching device 81 allows the timing controller 72 to be set to a self-diagnosis mode, thereby performing a self-diagnosis mode of the liquid crystal display module 71 and the system 60 as mentioned above. Accordingly, a user can cope with abnormal driving states of the liquid crystal display module 71 and/or the system 60 in conformity to the self-diagnosis result.

According to the invention as described above, the self-diagnosing switching device provided inside or outside the system includes a timing controller self-diagnosis function and may be controlled to diagnose, individually or integrally, an abnormal driving state of the system and/or the liquid crystal display module. Furthermore, an abnormal function of the liquid crystal display module may be controlled by the system during a test process for testing a connection state between the system and the liquid crystal display module. Furthermore, the test process may be implemented during the fabrication of the LCD or during the fabrication of the system (e.g., notebook computer) using the LCD. Accordingly, erroneous operations detected by the self-diagnosis function may improve the productivity and reliability of the fabrication processes used in forming the LCD and/or the system employing the LCD.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display comprising:

a liquid crystal display panel including pixel cells arranged in a matrix pattern;

a system for applying a timing synchronizing signal and video data;

a switching device for generating a predetermined driving control signal;

a self-diagnosing circuit for applying a timing control signal to the liquid crystal display panel at least partially in response to the predetermined driving control signal, wherein the timing control signal is based on one selected from the group consisting of the timing synchronizing signal and a free synchronizing signal having a predetermined frequency; and a driver connected to the liquid crystal display panel for displaying data on the liquid crystal display panel in correspondence with the timing control signal.

2. The liquid crystal display as claimed in claim 1, wherein the self-diagnosing circuit is included within a timing controller connected between the system and the driver.

3. The liquid crystal display as claimed in claim 1, wherein the timing control signal is based on the free synchronizing signal when the predetermined driving control signal is in an ON state.

4. The liquid crystal display as claimed in claim 1, further comprising:

a control signal line connected between the self-diagnosing circuit and the system for applying the predetermined driving control signal to the self-diagnosing circuit.

5. The liquid crystal display as claimed in claim 4, wherein the switching device is connected to the system for applying the predetermined driving control signal to the self-diagnosing circuit, via the control signal line.

6. The liquid crystal display as claimed in claim 1, wherein the self-diagnosing circuit includes:

an oscillator for generating the free synchronizing signal;

a signal presence determiner connected to the oscillator for comparing the timing synchronizing signal with the free synchronizing signal to generate a determining signal for indicating whether the timing synchronizing signal is inputted;

a control signal generator connected to the oscillator and the signal presence determiner for generating the timing control signal in response to the determining signal;

a data storing unit connected to the driver for storing a predetermined picture data different from the video data; and a self-diagnosis mode selector connected to the signal presence determiner for selectively applying the timing synchronizing signal to the signal presence determiner in response to the predetermined driving control signal.

7. The liquid crystal display as claimed in claim 6, wherein the switching device is connected to the self-diagnosis mode selector to apply the predetermined driving control signal to the self-diagnosis mode selector.

8. The liquid crystal display as claimed in claim 1, wherein the data displayed by the driver includes a predetermined picture data different from the video data when no timing synchronizing signal is input in the predetermined driving control signal having an OFF state is applied.

9. The liquid crystal display as claimed in claim 1, wherein the switching device is driven by a user.

10. The liquid crystal display as claimed in claim 1, wherein the predetermined frequency is equal to a frequency of the timing synchronizing signal.

11. The liquid crystal display as claimed in claim 1, wherein the timing control signal is based on the free synchronizing signal when the predetermined driving control signal is in an OFF state and no timing synchronizing signal is applied.

12. The liquid crystal display as claimed in claim 1, wherein the timing control signal is based on the timing synchronizing signal when the predetermined driving control signal is in an OFF state and a timing synchronizing signal is applied.

13. The liquid crystal display as claimed in claim 1, wherein the data displayed by the driver includes a predetermined picture data different from the video data when the predetermined driving control signal is in an ON state.

14. The liquid crystal display as claimed in claim 1, wherein the data displayed by the driver includes the video data when the predetermined driving control signal is in an OFF state and a timing synchronizing signal is applied.

15. A method of self-diagnosing a liquid crystal display comprising:

applying a timing synchronizing signal and video data from a system;

rearranging and outputting the video data applied from the system;

generating a predetermined driving control signal from a switching device;

generating a free synchronizing signal having a predetermined frequency;

applying a timing control signal to the liquid crystal display panel at least partially in response to the predetermined driving control signal, wherein the timing control signal is based on one selected from the group consisting of the timing synchronizing signal and the free synchronizing signal; and displaying the data on a liquid crystal display panel in correspondence with the timing control signal.

16. The method of self-diagnosing a liquid crystal display as claimed in claim 15, wherein the applied timing control signal is based on the free synchronizing signal when the predetermined driving control signal is in an ON state.

17. The method of self-diagnosing a liquid crystal display as claimed in claim 15, wherein the predetermined frequency is equal to a frequency of the timing synchronizing signal.

18. The method of self-diagnosing a liquid crystal display as claimed in claim 15, further comprising:

in response to the predetermined driving control signal, generating a determining signal indicating whether the timing synchronizing signal is inputted;

generating the timing control signal in response to the determining signal; and storing a predetermined picture data different from the video data.

19. The method of self-diagnosing a liquid crystal display as claimed in claim 15, further comprising displaying the data on the liquid crystal display panel as a predetermined picture data different from the video data when no timing synchronizing signal is input and the predetermined driving control signal having an OFF state is applied.

20. The method of self-diagnosing a liquid crystal display as claimed in claim 15, further comprising driving the switching device by a user.

21. The method of self-diagnosing a liquid crystal display as claimed in claim 15, wherein the applied timing control signal is based on the free synchronizing signal when the predetermined driving control signal is in an OFF state and no timing synchronizing signal is applied.

22. The method of self-diagnosing a liquid crystal display as claimed in claim 15, wherein the applied timing control signal is based on the timing synchronizing signal when the predetermined driving control signal is in an OFF state and a timing synchronizing signal is applied.

23. The method of self-diagnosing a liquid crystal display as claimed in claim 15, further comprising displaying the data on the liquid crystal display panel as a predetermined picture data different from the video data when the predetermined driving control signal is in an ON state.

24. The method of self-diagnosing a liquid crystal display as claimed in claim 15, further comprising displaying the data on the liquid crystal display panel as the video data when the predetermined driving control signal is in an OFF state and a timing synchronizing signal is applied.

* * * * *